US009439007B2

(12) United States Patent
Naumann

(10) Patent No.: US 9,439,007 B2
(45) Date of Patent: Sep. 6, 2016

(54) HEARING INSTRUMENT HAVING A ROUTING BUILDING BLOCK FOR COMPLEX MID STRUCTURES

(71) Applicant: Sivantos Pte. Ltd., Singapore (SG)

(72) Inventor: Frank Naumann, Bubenreuth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/692,940

(22) Filed: Apr. 22, 2015

(65) Prior Publication Data

US 2015/0256952 A1 Sep. 10, 2015

Related U.S. Application Data

(63) Continuation of application No. PCT/IB2013/054684, filed on Jun. 7, 2013.

(60) Provisional application No. 61/716,632, filed on Oct. 22, 2012.

(51) Int. Cl.
*H04R 25/00* (2006.01)

(52) U.S. Cl.
CPC ..... *H04R 25/608* (2013.01); *H04R 25/604* (2013.01); *H04R 2225/021* (2013.01); *H04R 2225/023* (2013.01); *H04R 2225/025* (2013.01)

(58) Field of Classification Search
CPC ..... H04R 25/604; H04R 25/608; H04R 2225/021; H04R 2225/023; H04R 2225/025
USPC ..... 381/324, 328, 322, 340
See application file for complete search history.

(56) References Cited

U.S. PATENT DOCUMENTS

| | | | | |
|---|---|---|---|---|
| 7,971,337 | B2 | 7/2011 | Kral et al. | |
| 2005/0105749 | A1 | 5/2005 | Niederdrank et al. | |
| 2010/0034410 | A1* | 2/2010 | Link | H04R 25/60 381/328 |

FOREIGN PATENT DOCUMENTS

| | | | |
|---|---|---|---|
| DE | 102009013078 | A1 | 5/2010 |
| EP | 1432278 | A2 | 6/2004 |

* cited by examiner

*Primary Examiner* — Sunita Joshi
(74) *Attorney, Agent, or Firm* — Laurence A. Greenberg; Werner H. Stemer; Ralph E. Locher

(57) ABSTRACT

A hearing instrument uses an MID (Molded Interconnect Device) to replace a complexly folded and expensive flexible PCB (Printed Circuit Board) inside hearing aids and enables the use of complex MID frames in hearing instruments. An additional routing building block is provided for the very complex routing around active electronic components, e.g. chips or ASICs and small passive electronic components. It includes a small, preferably rigid mini PCB provided for the complex routing. A large Flex-PCB is therefore replaced by a combination of an MID circuit frame and a mini PCB. The mini PCB enables complex routing of conducting paths and thus helps to increase integration while the MID circuit frame provides for a mechanical structure that enables and alleviates placing and connecting components such as microphones or receivers at respective mounting positions, e.g. at openings of a hearing aid housing.

4 Claims, 5 Drawing Sheets

HEARING INSTRUMENT HAVING A ROUTING BUILDING BLOCK FOR COMPLEX MID STRUCTURES

CROSS-REFERENCE TO RELATED APPLICATION

This is a continuation, under 35 U.S.C. §120, of copending International Application No. PCT/IB2013/054684, filed Jun. 7, 2013, which designated the United States; this application also claims the priority, under 35 U.S.C. §119(e), of Provisional Application No. 61/716,632, filed Oct. 22, 2012; the prior applications are herewith incorporated by reference in their entirety.

BACKGROUND OF THE INVENTION

Field of the Invention

The invention relates to hearing instruments.

Hearing instruments can be embodied, for example, as hearing devices. A hearing device serves to supply a hearing-impaired person with acoustic ambient signals, which are processed and amplified to compensate for or treat the respective hearing impairment. It basically is formed of one or more input transducers, a signal processing facility, an amplification facility and an output transducer. The input transducer is generally a sound receiver, e.g. a microphone and/or an electromagnetic receiver, e.g. an induction coil. The output transducer is generally implemented as an electroacoustic converter, e.g. a miniature loudspeaker, or as an electromechanical converter, e.g. a bone conduction earpiece. It is also referred to as an earpiece or receiver. The output transducer generates output signals, which are conducted to the ear of the patient with the aim of producing auditory perception in the patient. The amplifier is generally integrated in the signal processing facility. Power is supplied to the hearing device by a battery integrated in the hearing device housing. The key components of a hearing device are generally disposed on a printed circuit board as the circuit support or connected thereto.

Hearing instruments can not only be embodied as hearing devices but also as so-called tinnitus maskers. Tinnitus maskers are used to treat tinnitus patients. They generate acoustic output signals as a function of the respective hearing impairment and also, depending on the operating principle, as a function of ambient noise, in which the acoustic output signals are able to help reduce the perception of interfering tinnitus or other ear noises.

Hearing devices are known in various basic housing configurations. In the case of ITE (in the ear) hearing devices a housing, which contains all of the functional components, including a microphone and a receiver, is largely worn in the auditory canal. CIC (completely in canal) hearing devices are like ITE hearing devices but are worn completely in the auditory canal. In the case of BTE (behind the ear) hearing devices a housing with components such as a battery and a signal processing facility is worn behind the ear and a flexible sound tube conducts the acoustic output signals of a receiver from the housing to the auditory canal, where an ear mold is frequently provided on the tube for the reliable positioning of the tube end in the auditory canal. RIG-BTE (receiver in canal behind the ear) hearing devices are like BTE hearing devices but the receiver is worn in the auditory canal and in place of a sound tube a flexible earpiece tube conducts electrical signals instead of acoustic signals to the receiver, which is positioned at the front on the earpiece tube, generally in an ear mold for ensuring reliable positioning in the auditory canal. RIG-BTE hearing devices are frequently used as so-called open-fit devices, in which the auditory canal remains open for the passage of sound and air to reduce the interfering occlusion effect. Deep ear canal hearing devices are like GIG hearing devices. However, whereas GIG hearing devices are generally worn in the outside part of the outer auditory canal, deep ear canal hearing devices are pushed further toward the eardrum and are worn at least partially in the inside part of the outer auditory canal.

All of the housing configurations have in common the fact that the aim is to reduce the size of the housing as much as possible, to increase wearer comfort and reduce the visibility of the hearing device for cosmetic reasons.

Hearing instruments can also be embodied as telephones, mobile telephones, headsets, headphones, MP3 players or other telecommunication systems or electronic entertainment systems.

In the following the term hearing instrument refers to hearing devices, as well as tinnitus maskers and similar such devices, telecommunication systems and electronic entertainment systems.

SUMMARY OF THE INVENTION

It is accordingly an object of the invention to provide a hearing instrument having a routing building block for complex MID structures, which overcomes the hereinaforementioned disadvantages of the heretofore-known hearing instruments of this general type and which uses an MID (Molded Interconnect Device) to replace a complexly folded and expensive flexible PCB (Printed Circuit Board) inside hearing aids.

A Flex-PCB enables complex routing of conducting paths and placing of components such as microphones or receivers or antennae at respective mounting positions.

It is a further objective of the invention to enable the use of complex MID frames in hearing instruments. MID (Molded Interconnected Device) parts include electronic structures, e.g. contact pads and conductive paths, integrated on a plastic structure. This means that electronic components can be mounted on contact pads on a plastic frame and can be connected through conductive paths on the plastic frame. No additional PCB is required to connect the electronic components.

MID parts are usually shaped as 3D parts. A 3D assembly process is required in order to assemble 3D parts and mount electronic components. 3D assembly machines are capable of assembling 3D parts. Prior art MIDs include contact pads that are not of minimal size, e.g. they are larger in comparison to PCB contact pads used in hearing instrument PCBs. Therefore, high precision placement has up to now not been a major concern when assembling MID parts.

The size of contact pads on MID parts is preferably reduced significantly for use in hearing instruments. This decrease in the size of contact pads requires an increase in precision when placing components on MID parts in the assembly process. Therefore, since hearing instruments and related components are very small, higher precision when placing components on MID parts is required.

A further problem of MID is that it only allows for a single layer layout, while with PCB more complex layouts with more than 4 layers are possible. Therefore, in general, MID parts have less conductive layers, i.e. layers including conductive paths or contact pads, than PCBs, and thus allow for less complexity in the construction of conductive structures.

In order to solve those problems an additional routing building block is provided for the very complex routing around active electronic components, e.g. chips or ASICs, and passive electronic components. It includes a small, preferably rigid mini PCB provided for the complex routing. Therefore, the large Flex-PCB is replaced by a combination of an MID circuit frame and a mini PCB. In this combination the mini PCB enables complex routing of conducting paths and thus helps to increase integration while the MID circuit frame provides for a mechanical structure that enables and alleviates placing and connecting components such as microphones or receivers at the respective mounting positions, e.g. at openings of the hearing aid housing.

The routing building block has the following advantages:

Enabling for 3D assembly

Enabling fully automated assembly

Increasing complex structure requiring minimal space

Reducing complexity, avoiding complex and costly Flex-PCB

Enabling assembly of a huge number of small passive components in the fast 2D assembly process of the mini PCB (pre-mounting), less components to be assembled in the slower 3D assembly process of the MID circuit frame, and thus cost savings Decreasing overall price since complex and costly Flex-PCB is avoided and assembly is facilitated.

With the foregoing and other objects in view there is provided, in accordance with the invention, a hearing instrument, comprising a housing, an MID circuit frame, the MID circuit frame providing for a basic mechanical structure of the hearing instrument, electronic components including active and passive components, the electronic components being mounted on the MID circuit frame, a mini PCB mounted on the MID circuit frame, the mini PCB having more conductive layers than the MID circuit frame, and at least one active component mounted on the mini PCB.

In accordance with another advantageous feature of the invention, the active component includes at least one of a signal processing unit or an amplifier.

In accordance with a further advantageous feature of the invention, in addition to the at least one active component, passive components are mounted on the mini PCB.

In accordance with a concomitant advantageous feature of the invention, the mini PCB is a rigid PCB.

Other features which are considered as characteristic for the invention are set forth in the appended claims.

Although the invention is illustrated and described herein as embodied in a hearing instrument having a routing building block for complex MID structures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
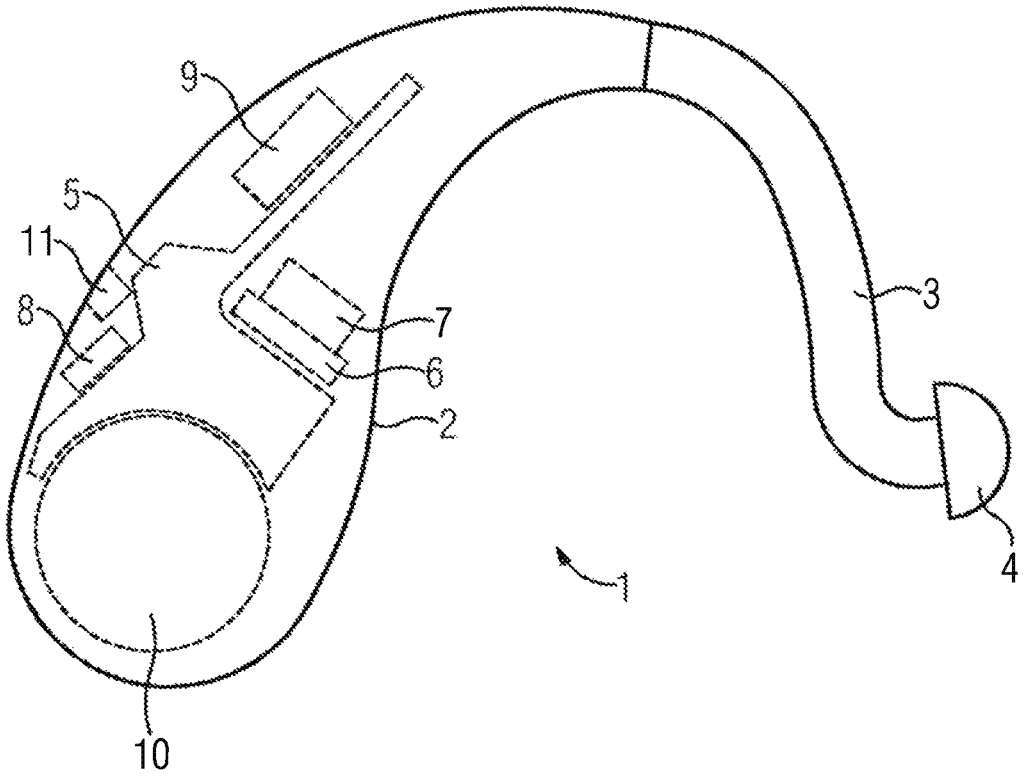
FIG. 1 is a diagrammatic, plan view of a BTE hearing instrument.

Referring now to the figures of the drawings in detail and first, particularly, to FIG. 1 thereof, there is seen a BTE hearing instrument 1. The BTE hearing instrument 1 includes a housing 2, a tube 3 and an earpiece 4. Within the housing 2 an MID circuit frame 5 is shown in dotted lines as well as a preferably rigid mini PCB 6, a signal processing unit 7, a non-illustrated receiver, a push button 9, a battery 10 and a microphone 8 with a microphone opening 11.

The mini PCB 6 acts as a routing building block. It includes more conductive layers than the MID circuit frame 5 and enables complex routing of conducting paths.

The MID circuit frame 5 provides for a mechanical structure that enables and alleviates placing and connecting components like the microphone 8 or receiver at respective mounting positions, e.g. at openings of the hearing aid housing. It provides for a basic mechanical structure of the hearing instrument 1, to which further components are mechanically and electrically mounted.

Components within the housing 2 are only shown for illustrative purposes and the illustration need not be complete, e.g. further components such as a telecoil or antenna might be included, that are not shown.

Figure 2:
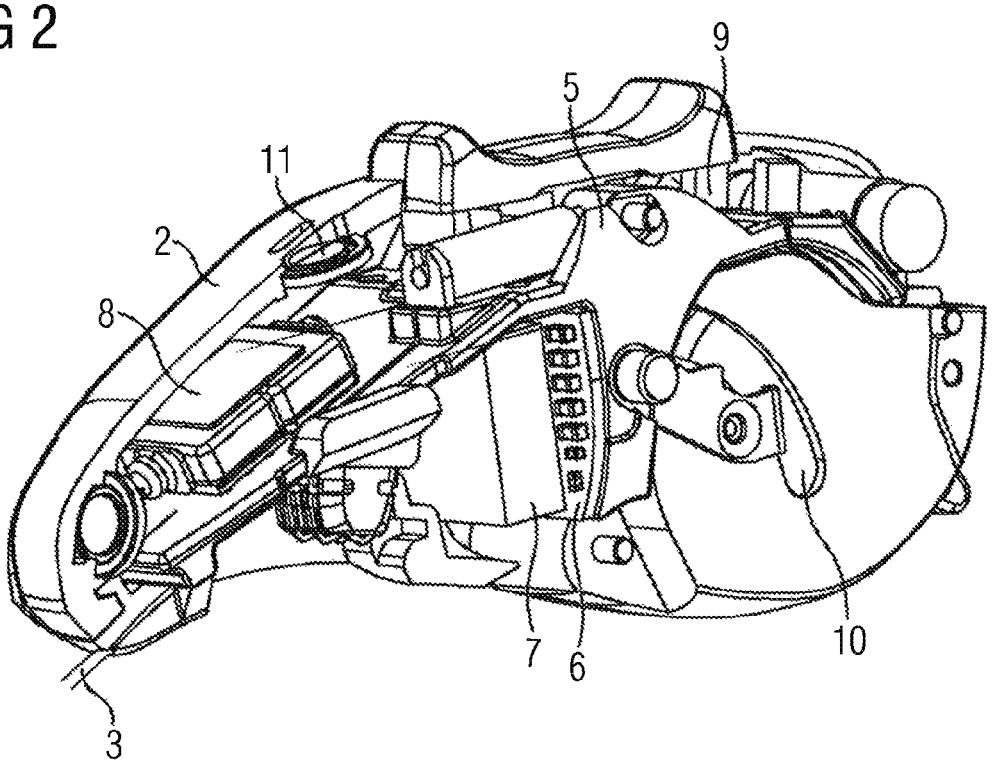
FIG. 2 is an enlarged, perspective view of the BTE hearing instrument with an MID frame.

An open half of the housing 2 is shown in FIG. 2. Within the housing 2 the MID circuit frame 5 is shown as well as the mini PCB 6, the signal processing unit 7, the microphone 8, the push button 9, the battery 10 and the microphone opening 11. Only a first section of the tube 3 is shown.

Figure 3:
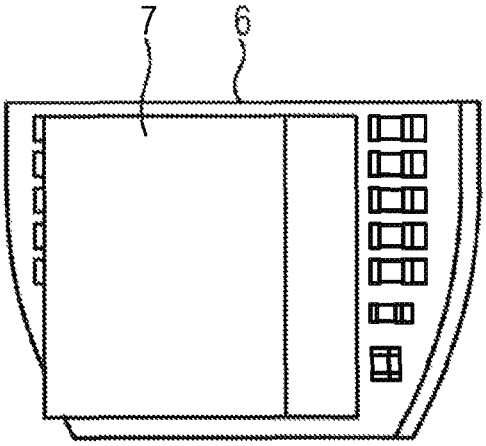
FIG. 3 is a plan view of a mini PCB with a signal processing unit.

FIG. 3 shows an enlarged illustration of the front side of the mini PCB 6. The signal processing unit 7 (active electronic component) is mounted to the mini PCB 6. The signal processing unit 7 is connected to the mini PCB 6 through a significant number of contact pads that are located between the mini PCB 6 and the signal processing unit 7 and are not visible in FIG. 3.

Figure 4:
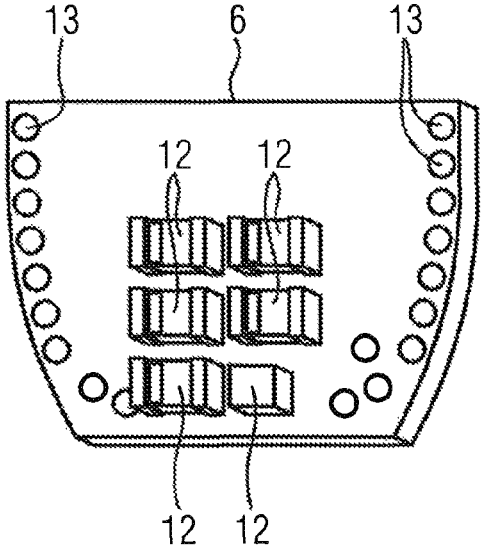
FIG. 4 is a plan view of the mini PCB with passive components.

FIG. 4 shows an enlarged illustration of the other side of the mini PCB 6. Additional passive electronic components 12 (e.g. resistors, capacitors, inductances) are mounted on the mini PCB 6. A number of circular contact pads 13 for connecting the mini PCB 6 to the MID circuit frame 5 are located on both the right and left side of this side of the mini PCB 6.

Figure 5:
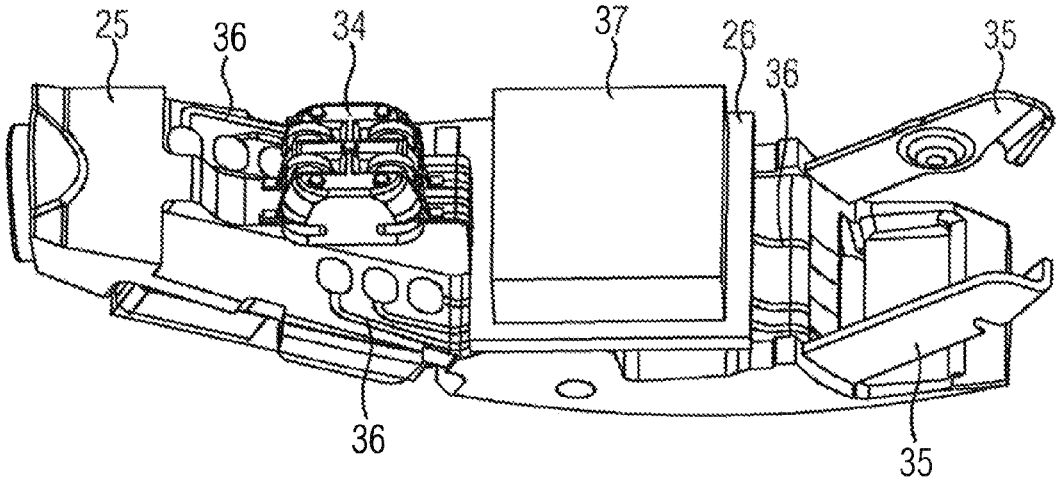
FIG. 5 is a perspective view of the MID frame with the mini PCB.

In FIG. 5 a differently shaped MID circuit frame 25 with a different embodiment of a preferably rigid mini PCB 26 and an active component 37, e.g. an amplifier, is shown. The mini PCB 26 acts as a routing building block. It includes more conductive layers than the MID circuit frame. The MID circuit frame 25 includes mounting brackets 35 for holding a non-illustrated battery on the right. The mini PCB 26 with the active component 37 is mounted in the middle of the MID circuit frame 25. Further components 34 are mounted on the left and back side of the MID circuit frame 25. The MID circuit frame 25 includes conductive paths 36 used to connect all of the components including the mini PCB 26.

FIGS. 4 and 5 illustrate different solder pad positions on the different preferably rigid mini PCBs 6, 26 explained above. The solder pads 13, 33 provide for the electrical and mechanical interconnection between the mini PCBs 6, 26 and the MID circuit frames 5, 25. Further contact pads for connecting the active components 7, 37, e.g. signal processing units, as explained above, are located on the other side of the mini PCBs that is not shown in FIG. 10.

In a preferred embodiment, solder bumps pre-mounted to the mini PCB. By using pre-mounted solder bumps the use of solder paste and the necessity to apply solder paste to the complex 3D geometry of the MID circuit frame can be avoided. Instead pre-mounted solder bumps allow for assembling components on the mini PCB with a 3D assembly system, fixing them with glue or a jig, and soldering in a solder oven. Thus, by using solder bumps, automatic assembly is enabled or facilitated.

The use of solder bumps in connection with the routing building block thus has the additional advantage of avoiding much of the solder paste at the 3D part, and thus leads to cost and time savings.

Figure 6:
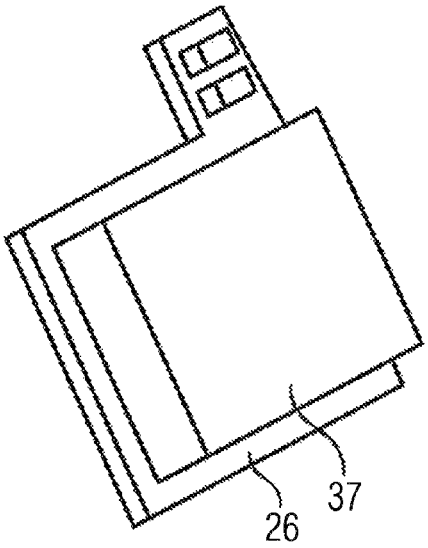
FIG. 6 is a perspective view of the mini PCB with the signal processing unit.

The front side of the mini PCB 26 is shown in FIG. 6. A signal processing unit (active component 37) is mounted through a significant number of contact pads on the mini PCB 26. The contact pads are located between the signal processing unit 37 and the mini PCB 26 and are not visible in FIG. 6.

Figure 7:
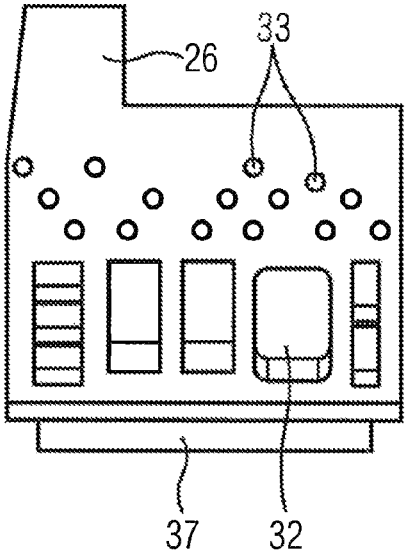
FIG. 7 is a plan view of the mini PCB with passive components.

FIG. 7 shows the back side of the mini PCB 26. Passive components 32 having a rectangular shape are mounted on the back side and a number of circular contact pads 33 for connecting the mini PCB 26 with the MID circuit frame 25 are located on the upper section of the back side.

The mini PCB 26 is assembled in a first manufacturing step in which the active components 37 and the passive components 32 are mounted on the mini PCB 26. In a second manufacturing step the thus pre-assembled mini PCB 26 and the further components 34 are mounted on the MID circuit frame 25.

Figure 8:
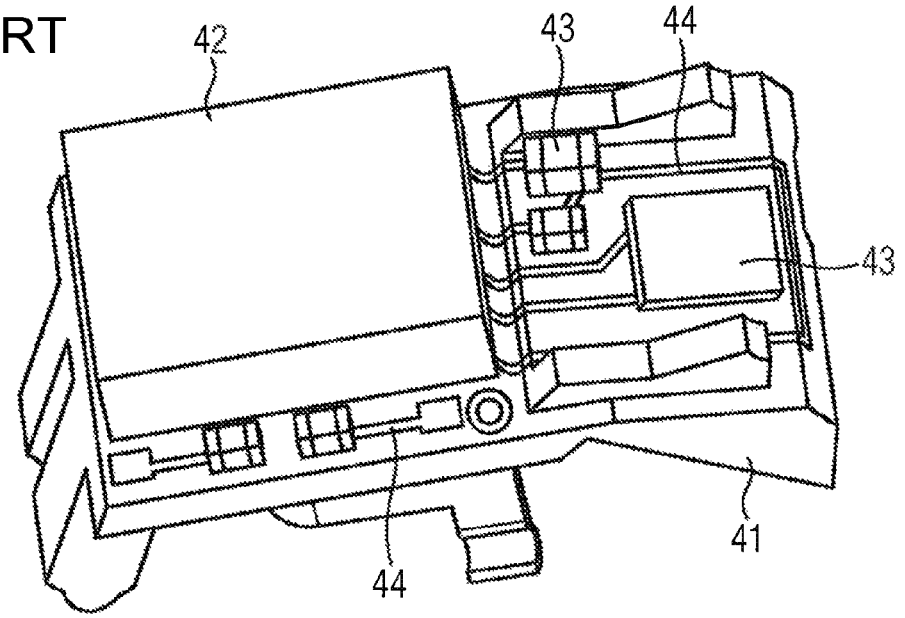
FIG 8 PRIOR ART
FIG. 8 is a perspective view of the MID frame without the mini PCB.

FIG. 8 shows a prior art MID circuit frame 41 in order to illustrate the advantage of using a mini PCB. No mini PCB is mounted on the MID circuit frame 41 in FIG. 8. A large active component 42, e.g. a signal processing unit, having a rectangular shape is mounted on the left side of the front side of the MID circuit frame 41. Further components 43 are mounted beside the signal processing unit 42. A large number of comparably complex routed conducting paths 44 connect the components mounted to the MID circuit frame 41.

Figure 9:
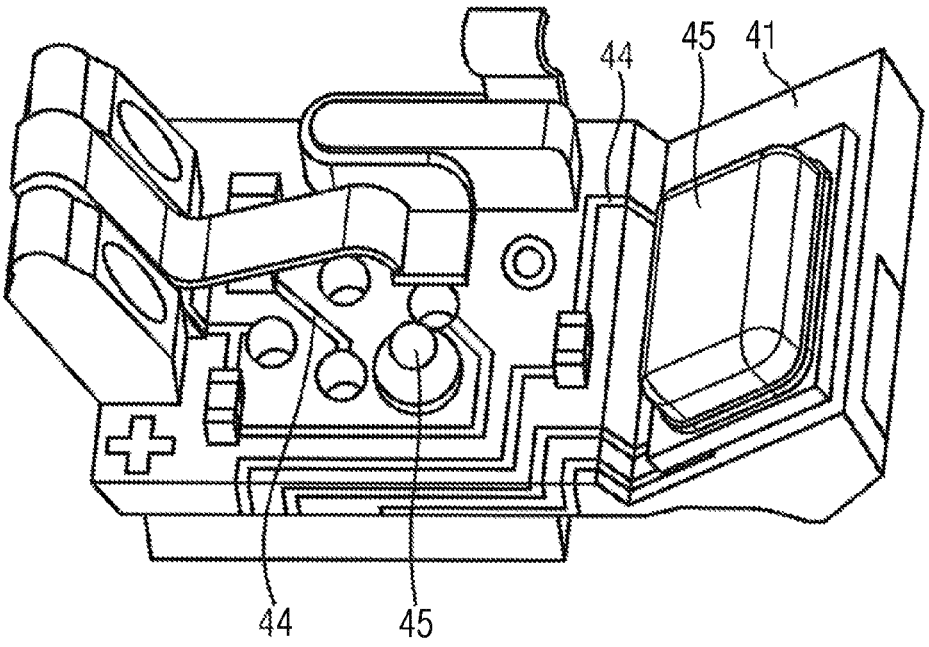
FIG 9 PRIOR ART
FIG. 9 is a perspective view of an MID frame routing.

FIG. 9 shows the back side of the prior art MID circuit frame 41. Further components 45 are mounted there. The conducting paths 44 connect the components mounted to the MID circuit frame 41.

It can be seen from FIGS. 8 and 9 that the layout of the conducting paths 44 is much more complex as compared to the MID circuit frame with the mini PCB shown in the previously-described embodiments of the invention. The conductive paths 44 require more area on the MID circuit frame 41. That area is not available for placing components. That causes an increase in size of the MID circuit frame 41 and in addition makes it difficult to place and connect components such as a receiver or microphones in their respective mounting positions. Therefore, without using an additional mini PCB, hearing instruments with more functionality (additional microphones, wireless coils, T-Coils, DAI-Interfaces), that at the same time meet miniaturization requirements, would be hard or impossible to build.

Figure 10:
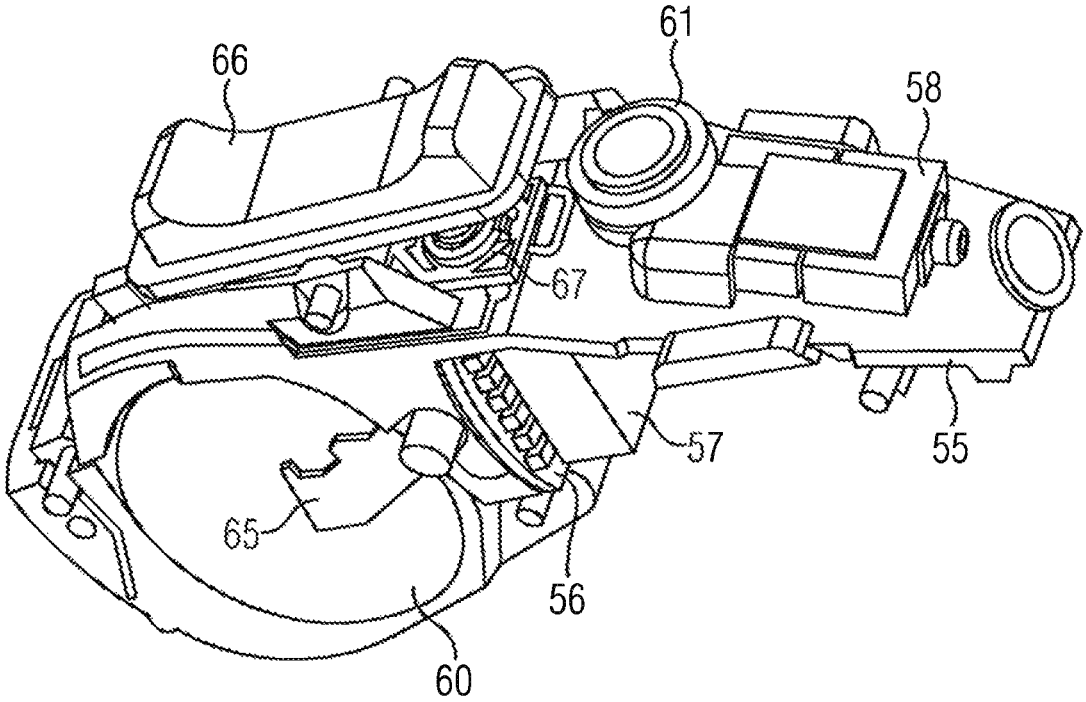
FIG. 10 is a perspective view of the mini PCB with the passive components.

A further embodiment of an MID circuit frame 55 is shown in FIG. 10. A preferably rigid mini PCB 56 with an active electrical component 57, e.g. a signal processing unit, as well as a microphone opening 61, a microphone 58 and a battery bracket 65, are mounted to the MID circuit frame 55. The mini PCB 56 acts as a routing building block. It includes more conductive layers than the MID circuit frame. The battery bracket 65 holds a battery 60. A handle 66 is used to manually activate a push button 67 that is located under the handle 66 and is also mounted to the MID circuit frame 55.

The invention claimed is:

1. A hearing instrument comprising:
a housing;
an MID circuit frame providing a basic mechanical structure of the hearing instrument;
electronic components including active and passive components mounted on said MID circuit frame;
a mini PCB disposed within said housing and mounted on said MID circuit frame, said mini PCB including more conductive layers than said MID circuit frame; and
at least one active component mounted on said mini PCB.

2. The hearing instrument according to claim 1, wherein said active component is at least one of a signal processing unit or an amplifier.

3. The hearing instrument according to claim 1, which further comprises passive components mounted on said mini PCB in addition to said at least one active component.

4. The hearing instrument according to claim 1, wherein said mini PCB is a rigid PCB.

* * * * *